US005426577A

United States Patent [19]

Gordin et al.

[11] Patent Number: 5,426,577

[45] Date of Patent: Jun. 20, 1995

[54] POLE-MOUNTED LIGHTING SYSTEM

[75] Inventors: Myron K. Gordin; Jim L. Drost, both of Oskaloosa, Iowa

[73] Assignee: Musco Corporation, Oskaloosa, Iowa

[21] Appl. No.: 21,497

[22] Filed: Feb. 23, 1993

[51] Int. Cl.[6] ..... F21S 13/10

[52] U.S. Cl. ..... 362/431; 174/45 R; 248/218.4

[58] Field of Search ..... 362/221, 249, 250, 370, 362/396, 431; 174/45 R; 248/219.4, 218.4

[56] References Cited

U.S. PATENT DOCUMENTS

| | | | |
|---|---|---|---|
| Re. 30,000 | 5/1979 | Loffler et al. | 362/61 X |
| D. 88,513 | 12/1932 | Farnam . | |
| D. 257,891 | 1/1981 | Drost et al. | D26/69 |
| D. 337,168 | 7/1993 | Gordin et al. | D26/67 |
| 689,387 | 12/1901 | Crossland . | |
| 839,272 | 12/1906 | Crow | 52/697 |
| 976,879 | 11/1910 | Hughs . | |
| 1,244,652 | 10/1917 | Southgate | 182/90 X |
| 1,567,301 | 12/1925 | Ross | 182/90 |
| 3,270,480 | 9/1966 | Beeker . | |
| 3,325,950 | 6/1967 | Pfaff, Jr. . | |
| 3,664,624 | 5/1972 | Freegard | 248/218.4 |
| 3,865,498 | 2/1975 | Okuto et al. | 403/292 |
| 4,190,881 | 2/1980 | Drost et al. | 362/250 |
| 4,220,981 | 9/1980 | Koether | 362/61 |
| 4,374,407 | 2/1983 | Drost et al. | 362/432 |
| 4,423,471 | 12/1983 | Gordin et al. | 362/96 |
| 4,450,507 | 5/1984 | Gordin | 362/61 |
| 4,712,167 | 12/1987 | Gordin et al. | 362/233 |
| 4,878,160 | 10/1989 | Reneau et al. | 362/269 |
| 4,894,759 | 1/1990 | Siems | 362/250 |
| 5,275,368 | 1/1994 | Hall et al. | 248/218.4 |

FOREIGN PATENT DOCUMENTS 1162522 9/1958 France .

OTHER PUBLICATIONS

Centrecon, "Sportsliner II-50", 4 page brochure (date unknown) U.S.A.

Centrecon, Incorporated, "FL" Series Floodlighting, pp. FL-20.0-20.1 (date unknown) U.S.A.

*Primary Examiner*—Stephen F. Husar

*Attorney, Agent, or Firm*—Zarley, McKee, Thomte, Voorhees & Sease

[57] ABSTRACT

Pole mounted lighting system including mounting components to mount such things as an integrated multiple cross-arm assembly to a pole, a remote ballast box to the pole, or an integrated cross-arm ballast box to the pole. The mounting structures include adjustable connection members which allow customization of fit to different size poles.

14 Claims, 7 Drawing Sheets

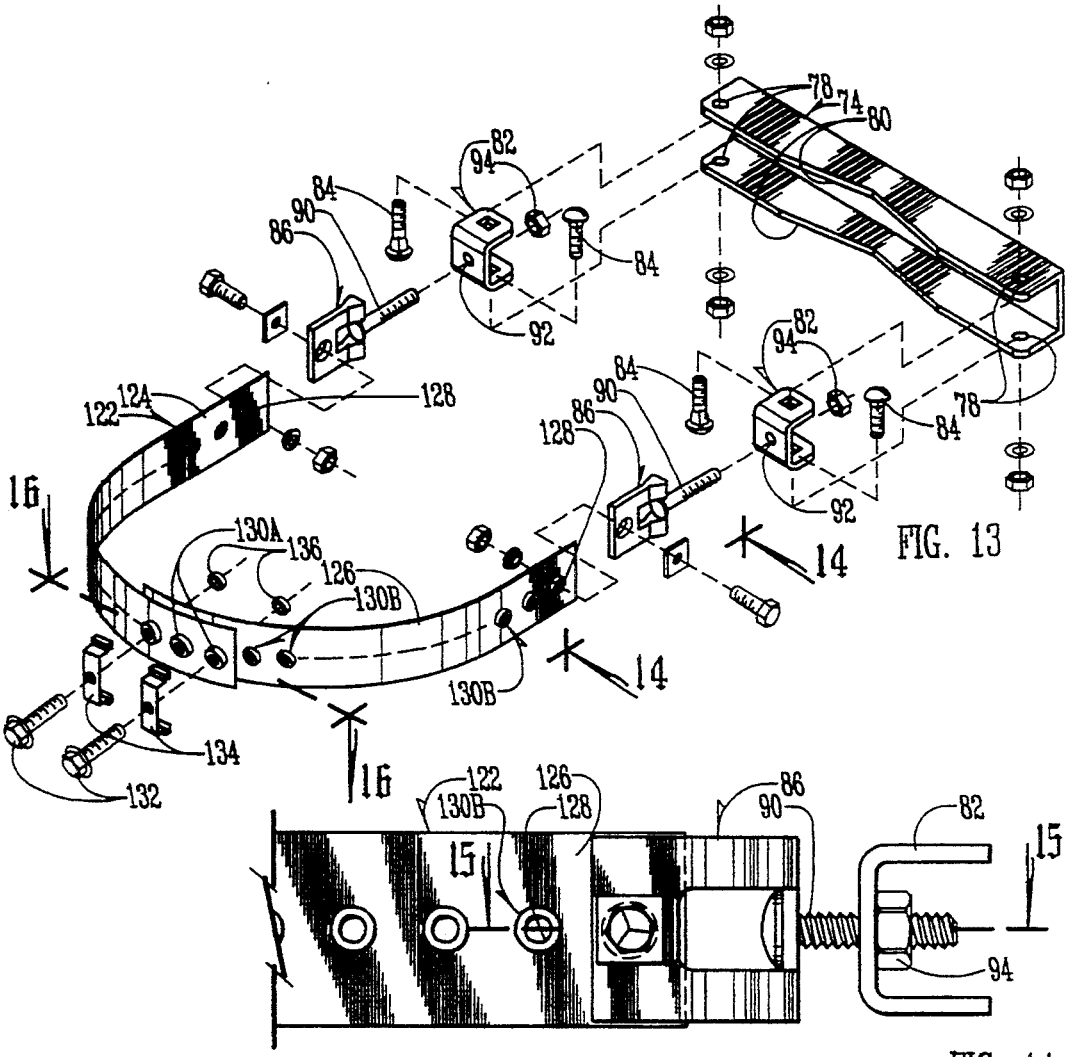
FIG. 13
FIG. 14
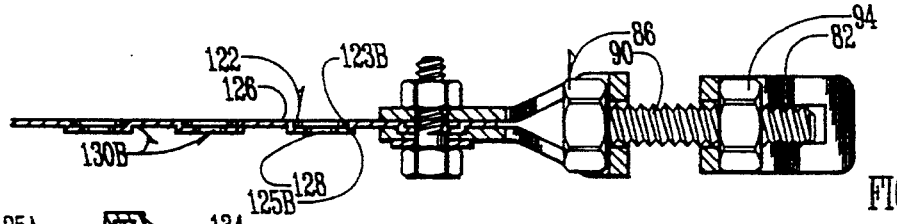
FIG. 15
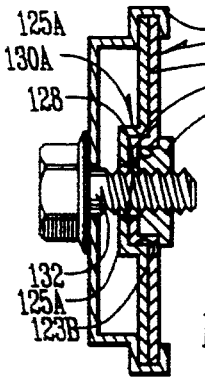
FIG. 17
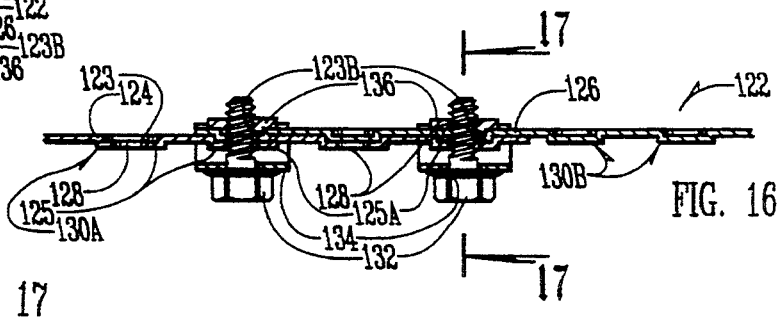
FIG. 16

POLE-MOUNTED LIGHTING SYSTEM

BACKGROUND OF THE INVENTION

A. Field of the Invention

The present invention relates to pole-mounted lighting systems, and in particular, to means and methods for mounting on poles various structures related to elevated lighting fixtures for large area lighting.

B. Background of the Invention

There are many examples of pole-mounted large area lighting systems. They include sports field lighting; such as softball, baseball, football, soccer fields and the like. It also includes tennis court lighting, and playground lighting; and could also include such things as parking lot lighting.

The most conventional way of elevating lighting fixtures to enable large scale lighting is to install poles in the ground and then secure structures to the poles to facilitate such lighting. It is usually desirable to elevate the lighting fixtures as high as economically practical. The higher the light pole the costlier. Therefore there is usually a practical limit on the height of poles which is directly related to cost. Multiple fixtures normally are positioned on some sort of a cross-arm which is then secured to the pole. Multiple cross-arms on each pole are possible. Other structures, such as electrical boxes containing ballasts, circuit breakers, fuses, switches, and other electrical components are also commonly suspended along the length of the pole. Such components can either be associated with the cross-arms, or be spaced apart from and usually lower on the pole.

While it may appear to be elementary to accomplish lighting systems of this type, a number of different design criteria and considerations are involved. For example, it is not trivial to secure structures of substantial size and weight to a pole. The structures must be mounted securely and in a durable manner for long term use. The mounting structure must also be strong to support cross-arms, fixtures, and such things as ballast boxes; particularly in light of wind loads that exist on outdoors systems.

Another set of considerations involves cost of manufacturing and installation. As with most commercial goods, the cost of making the goods impacts significantly on the cost of the goods to consumers. There is normally high incentive to be able to present the lowest price to consumers; therefore there is high incentive to devise systems which are as inexpensive as possible to manufacture. This impacts on design and the type of materials utilized.

Another consideration is the shipping of these components from factory to installation site. Limits of size and weight come into play. For example, shipment via semi-trailer limits the maximum dimensions of pieces.

Still further, there is generally a high incentive to offer goods to consumers that are easy to install while meeting performance requirements for the types of components.

Still further, it is usually desirable that the goods be flexible and customizable to varying installation situations. In other words, it is most times advantageous to have, for example, mounting systems that are generally universal with the ability to work for different mounting situations such as, for example, different heights, diameter, and types of poles.

In the field of the present invention, these considerations apply. There are practical limitations on the number of light fixtures that can be suspended from each pole. It depends on factors such as the type of pole (examples are wood, steel, concrete), the height of the pole, and the lighting requirements associated with that pole. As a general rule it is most cost-effective to be able to elevate a maximum number of fixtures from each pole, as the poles and their installation comprise a significant amount of the cost for lighting systems.

In the same sense, because structures such as cross-arms, lighting fixtures, and ballast boxes are substantial in size, and need to be installed at elevated positions from the ground, it is highly desirable that the mounting procedures be as simple and quick as possible. With this is the need for flexible, almost universal, mounting components that can be adapted easily by the installers for different situations.

Many consumers also take into consideration how a certain system visually looks from an attractiveness standpoint, in cooperation with its functionality.

There are currently many ways of suspending lighting fixtures and related structures on poles for accommodating large scale lighting. It is submitted, however, that there is room for improvement in this field of art. Two specific examples are set forth below.

As previously mentioned, it is highly desirable to suspend as many lighting fixtures per pole as possible, in most situations. Currently a conventional way to attach fixtures to a pole is to mount one or more cross-arms to the pole, each cross-arm bearing multiple light fixtures and having separate pole-attaching hardware. One time saver that exists in the art is to connect the light fixtures to the cross-arm before raising the entire cross-arm assembly to its position at the top of the pole. However, if more than one bar of lights is required, significant time and effort must be utilized to position and then secure the first cross-arm, then the second, then any others.

Another example involves ballast boxes. They are normally secured by brackets that surround the pole and connect to the top and bottom of the ballast box. However, when installing and cinching the box against the pole, certain problems can exist. There are times when rotational or other forces can deform or even permanently warp the ballast box. This can significantly affect the ballast box in, for example, causing misalignment of any door on the box so that it does not fit securely, which in turn can lead to water leakage or other detrimental and potentially serious problems for the lighting system. For example, if the ballast box is not accurately aligned along the pole, when tightened, deformation or warping can occur. Another instance is if the pole is crooked. A still further example involves cases where wood poles are used and mounting brackets sink into the wood at different rates. Knots or other discontinuities in poles can also cause problems. It is to be understood that other situations can also cause problems resulting in the risk of deformation or warpage.

It is therefore the primary object of the present invention to provide a pole-mounted lighting system which improves over some of the problems and deficiencies in the art.

another object of the present invention is to provide a pole-mounted lighting system which securely and durably mounts structures to poles, but limits potentially damaging stresses on the structures when being mounted.

Another object of the present invention is to provide a pole-mounted lighting system which is easy to mount to the pole in a minimum amount of time and steps.

A still further object of the present invention is to provide a pole-mounted lighting system which is flexible in the types of structure and poles with which it can be used.

Another object of the present invention is to provide a pole-mounted lighting system which deters or avoids mounting problems related to misalignment of structures with respect to the poles, crooked poles, poles having surface irregularities, and poles such as wood poles which are crooked or have varying wood density, knots, or other discontinuities.

Another object of the present invention is to provide a pole-mounted lighting system which allows a significant amount of needed structure, for example, lighting fixtures, ballasts, or other electrical components, to be mounted on an existing pole.

another object of the present invention is to provide a light-mounted lighting system which allows for easy electrical interconnection of electrical components, even if they are spaced apart from one another on the pole.

These and other objects, features, and advantages of the present invention will become more apparent with reference to the accompanying specification and claims.

SUMMARY OF THE INVENTION

The pole-mounted lighting system of the present invention includes an attachment system for structures, such as cross-arm assemblies and ballast boxes, to a pole. The cross-arm assemblies comprise either two or more cross-arms rigidly secured together, where the entire collection of cross-arms forms an integral structure that can then be mounted to a pole, or a cross-arm and ballast combination which can in one step be mounted to a pole.

A ballast box, containing multiple ballasts and other electrical components for a plurality of light fixtures, can be remotely positioned along the pole from the light fixtures but easily and quickly installed to the pole.

An aspect of the invention includes mounting components for these structures which can be customized to securely and easily mount the structures to a wide variety of pole types, shapes, and sizes. Another aspect of the invention involves mounting components which assist in keeping the structure centered on the pole without stress that could detrimentally deform the structure when tightened to the pole.

BRIEF DESCRIPTION OF THE DRAWINGS

FIG. 13 is a still further embodiment of the mounting brackets for FIG. 6 shown in perspective exploded form.

FIG. 14 is an enlarged partial elevational view taken along line 14—14 of FIG. 13.

FIG. 15 is a sectional view taken along line 15—15 of FIG. 14.

FIG. 16 is an enlarged sectional view taken along line 16—16 of FIG. 13.

FIG. 17 is a still further enlarged sectional view taken along line 17—17 of FIG. 16.

DETAILED DESCRIPTION OF PREFERRED EMBODIMENT

A. Overview

Figures 1, 2:
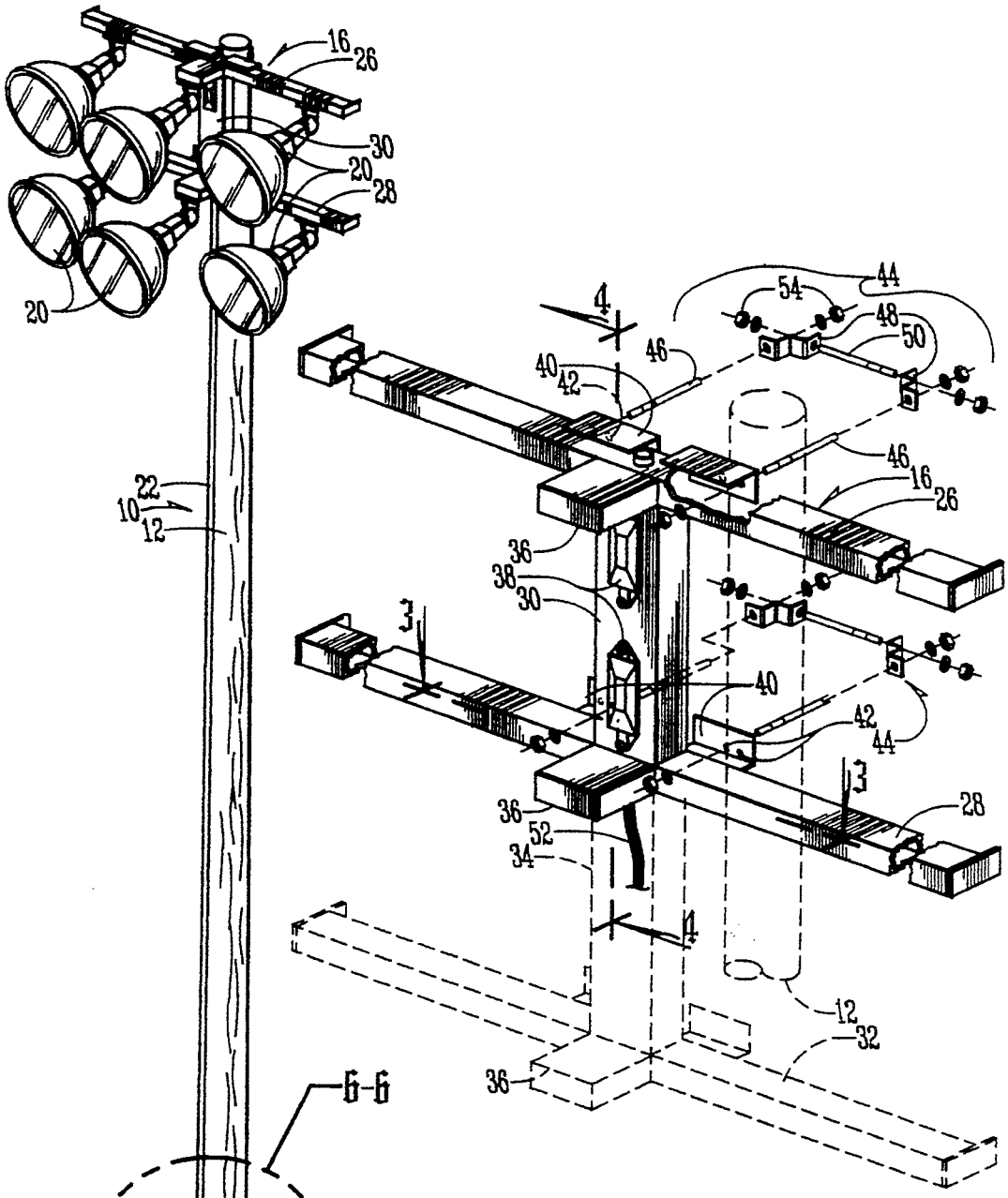
FIG. 1 is a perspective view of a light pole, cross-arm assembly, light fixtures, and remotely positioned ballast box, according to one embodiment of the present invention.
FIG. 2 is an enlarged perspective view of the cross-arm assembly of FIG. 1 showing mounting brackets in exploded fashion, the light pole in ghost lines, and an optional third cross-arm in ghost lines.

To assist in an understanding of the invention, a detailed description of preferred embodiments will now be set forth. It is to be understood that these embodiments are examples of some forms the invention can take, but do not define all the forms the invention can take.

B. General Configuration—FIG. 1

This description will refer to the drawing figures, and will reference certain parts and locations in the figures by reference numerals or characters. The same reference numerals or characters will be used to identify the same or similar parts and locations in all of the figures unless otherwise explained.

FIG. 1 illustrates in perspective form one preferred embodiment of the invention (which will be generally designated as embodiment 10) on a light pole 12.

It is to be understood for purposes of this description that light pole 12 consists of a pole several tens of feet tall and made of wood (solid concrete would be another example). It is to be understood that the invention could be used with a variety of types of poles, including hollow metal or concrete poles, and even tapered poles. The pole 12 is secured in the ground by methods known in the art.

In FIG. 1, what will be called a cross-arm assembly 16 is mounted at the top of pole 12 and what will be called a remote ballast box 18 is mounted near the bottom of pole 12.

Light fixtures 20 are positioned on cross-arm assembly 16. In this case six such fixtures 20 exist. On each bar, in this embodiment, a fixture 20 is mounted on opposite sides of the bar, and a fixture 20 is mounted in between. As is shown in FIG. 1, an electrical conduit 22 extends from ballast box 18 up to cross-arm assembly 16 for purposes of providing electrical power and control wires to fixtures 20. It is to be understood that such wiring could be alternatively routed inside of pole 12, if hollow metal or concrete, for example, and that electrical power is received by ballast box from an electrical power source (not shown).

FIG. 1 also illustrates that conventionally ballast box 18 has a door 24 which can be opened for access to components such as ballasts, fuses, circuit breakers, switches, etc. Such a door 24 needs to seal securely to box 18 to prevent water leakage and protect the components inside box 18.

C. Cross-arm assembly—FIGS. 2–5

FIG. 2 shows in more detail the exact structure of cross-arm assembly 16. Top cross-arm 26 and bottom cross-arm 28 are parallel and spaced apart by interconnecting member 30. Assembly 16 is unitary and basically "I" shaped. Each component 26, 28, and 30 is at least partially hollow to allow interior wiring to fixtures 20. It is to be understood that the underside of cross-arms 26 and 28 have spaced apart openings and apertures which allow fixtures 20 to be bolted onto the underside of arms 26 and 28.

As shown in FIG. 2, arms 26 and 28 are two inches in height and three inches in depth. Component 30 is four inches wide by three inches in depth. Other sizes are possible. The length of arms 26 and 28 can be made to desired lengths, within practical constraints. For example, the wind load on fixtures such as fixtures 20 limits the number of fixtures and therefore the maximum length of arms 26 and 28. FIG. 2 shows that additional cross-arms (such as cross-arm 32 in ghost lines) can be added by also adding an appropriate interconnecting member (see member 34 in ghost lines in FIG. 2). It is preferred that assembly 16 consist either of two or three cross-arms because any more cross-arms would make it difficult to ship on standard-sized trucks. It is further to be understood that the number of fixtures 20 that can be suspended from each cross-arm assembly 16 is selectable. FIG. 1 shows six such fixtures as an example only. By extending the length of cross-arm, up to, for example, seven fixtures per cross-arm are reasonable. Therefore, with three cross-arms, assembly 16 could utilize up to twenty-one or so fixtures 20.

Cross-arm assembly 16 of FIG. 2 has several other features. A short arm 36 extends from cross-arms 26 and 28 (and 32 if used) orthogonally (mutually perpendicular) with respect to each cross-arm and interconnecting member at their junction. Each arm 36 has on its bottom surface the appropriate openings or structures to mount a fixture 20, as shown in FIG. 1. Without this arm 36, it would not be possible to mount fixture 20 in that manner at the junction of cross-arm and interconnecting member, and which in this case is generally at the center of the cross-arm.

Cover plates 38 in FIG. 2 sealingly close off openings in interconnecting member 30 which allow access to the interior wiring of assembly 16. "L" brackets 40, on top and bottom cross-arm 26 and 28, and on opposite sides of interconnecting member 30, have apertures 42 which cooperate with what will be referred to as the mounting brackets 44 of FIG. 2, to secure cross-arm assembly 16 to pole 12. Note that different sets of holes 42 exist to assist in mounting for different sized poles.

In FIG. 2 mounting brackets 44 consist of threaded rods 46 which are securable through apertures 42 in "L" brackets 40, and "W" brackets 48 which cooperate with threaded rod 50 and threaded rods 46 to surround and then allow tightening of assembly 16 against pole 12 by threadably securing the nuts and washers (as shown) onto threaded rods 46 and 50. These arrangements allow the secure and strong attachment of assembly 16 to pole 12 but with a high degree of adjustability and flexibility for different sizes of pole 12. Other arrangements are possible.

FIG. 2 also shows that a wiring harness 52 can be utilized to extend into assembly 16 to allow pre-wired, pre-attachment of fixtures 20 to cross-arm assembly 16 prior to raising it up on pole 12 for securement in place. The work required to wire up fixtures 20 can all be done on the ground or at a factory which eliminates such critical and time consuming work which would otherwise have to be done at the top of light pole 12.

In the preferred embodiment, interconnecting member 30 is welded to top and bottom cross-arms 26 and 28, which are made of steel or similar material. Other ways of securing these components into an integral unit are possible.

Figure 3:
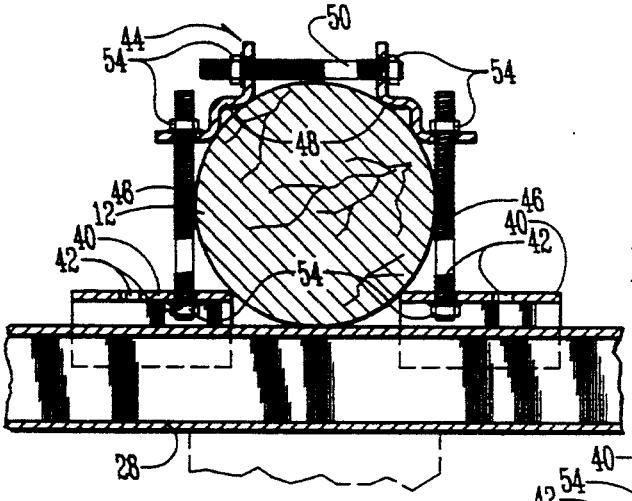
FIG. 3 is an enlarged sectional view taken along line 3—3 of FIG. 2.
Figure 4:
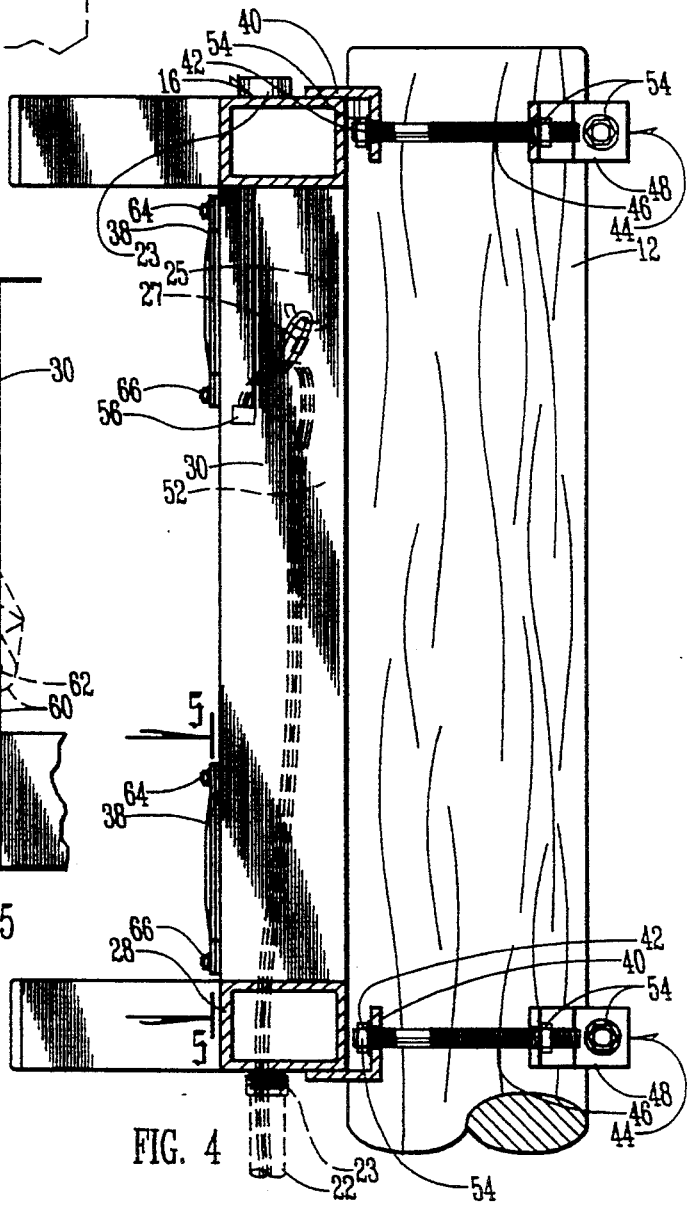
FIG. 4 is an enlarged partial sectional view taken along line 4—4 of FIG. 2.

FIGS. 3 and 4 depict cross-arm assembly 16 as secured to light pole 12. As can be understood, by selectively tightening nuts 54 on the threaded rods 46 and 50, serves to bring "W" brackets 48 and cross-arm assembly 16 into abutment with pole 12, and cinch or clamp assembly 16 to pole 12. By watching "W" brackets 48, the installer can accurately turn nuts 54 upon threaded rods 46 and 50 to accurately position "W" brackets 48 so that the whole mounting bracket 44 (including "L" brackets 42, threaded rods 46 and 50, and "W" brackets 48) is centered and in that condition offers the best clamping action.

FIG. 4 illustrates that utilization of mounting brackets 44 at both the top and bottom of assembly 16 will hold the entire assembly 16, with fixtures 20 mounted thereon, in place at the top of pole 12. FIG. 4 also illustrates wiring harness 52 with a quick connect connector 56 which can be positioned inside assembly 16 and allows the wiring going to fixtures 20 to be quickly connected up. The opposite end of wiring harness 52 can extend out of the bottom of cross-arm assembly 16 through conduit 22 and be cut to length once assembly 16 is in place to match up with the position of a remote ballast box. Note in FIG. 4 that the wiring bundle or harness 52 extends through conduit 22 (which is connected to assembly 16 at connection 23) up into component 30. A J-hook 25 is secured by welding or otherwise to the interior of 30. A kellum-grip 27 surrounds harness 52 and is used to hang harness 52 from hook 25 so that plug 56 can then be easily assessable through the openings which are covered by cover plates 38.

Figure 5:
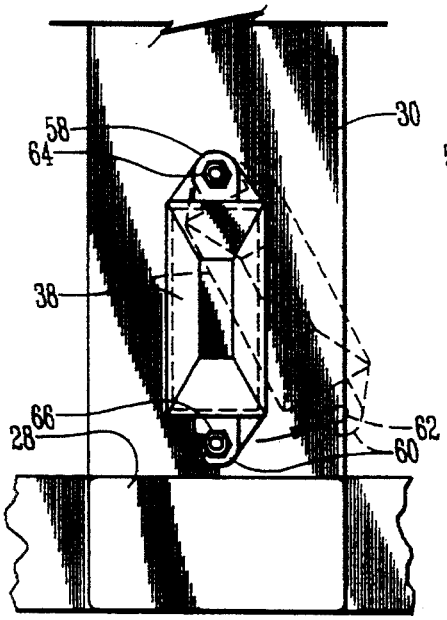
FIG. 5 is an isolated elevational view taken along line 5—5 of FIG. 4.

FIG. 5 illustrates a cover plate 38. A top ear 58 is bolted to interconnecting member 30. A bottom ear 60 has a C-shaped cutout 62 which allows cover 38 to be swung away around the pivot axis of bolt 64, for access into the interior of assembly 16. Cover 38 can then be easily swung back into position and secured into place by bolt 66. It is to be understood that this arrangement eliminates the need to completely remove cover 38 and also utilizes gravity to an extent to swing cover 38 back into position when released. A gasket or O-ring can be placed between cover 38 and member 30 to seal the opening.

D. Mounting System FIGS. 6–9

FIGS. 6–9 illustrate an embodiment for a mounting system for securing structures to a pole 12. In particular, this embodiment depicts the mounting of a ballast box 18. The system can be used, however, for mounting other structures or components.

To illustrate some of the advantages of the mounting system of FIGS. 6–9, the previously discussed problems with mounting ballast boxes will be referred to. Ballast boxes like box 18 are generally made of relatively thin metal. If such a box were to be connected to pole 12 by mounting components such as those shown in FIG. 44, there is the risk that when tightening down nuts 54, uneven pressure or stress will be created at one corner or portion of ballast box 18. This in turn could cause the warping of box 18. If the warping is severe enough, it could affect the performance of the box 18; for example, the door 24 may not close, water leakage may occur through the door or a seam in the box, or other environmental conditions may adversely affect box 18 or the contents of box 18. As previously discussed, such warpage can be caused by the box being originally misaligned or mis-centered on the pole before tightening of the mounting hardware.

Still further, mounting components such as brackets 44 of FIG. 2, are time consuming in their installation because of all the nuts 54 that must be secured, and the skill required to position and center the structure while being mounted.

Figure 6:
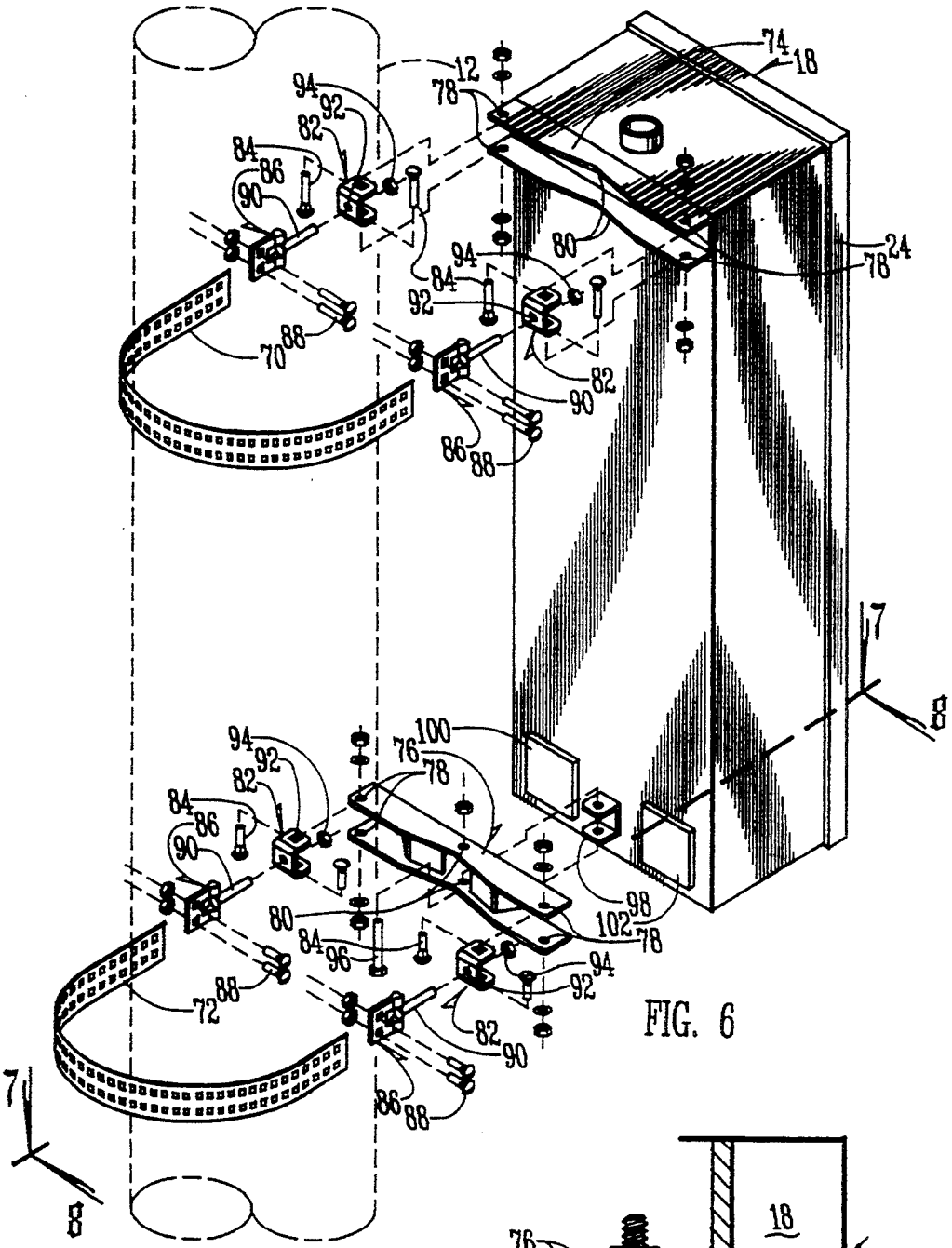
FIG. 6 is an enlarged perspective view of the ballast box shown at line 6—6 of FIG. 1, from a generally opposite direction from FIG. 1, showing the mounting components in exploded fashion and the light pole in ghost lines.

In FIG. 6 there is shown a mounting system which includes top strap 70, bottom strap 72, fixed connection bracket 74, and pivoting connection bracket 76.

Fixed connection bracket 74 is rigidly secured to the top back side of ballast box 18. It is C-shaped in cross section (with its open side facing out), has apertures 78 at opposite side ends, and V-shaped cutouts or recesses 80 along its center to facilitate reception and centering of pole 12 in bracket 74. C-shaped receptors 82 are attachable by bolts 84 to opposite ends of bracket 74. Adjustment connectors 86 are fixable to opposite ends of top strap 70 by bolts 88. Adjustment connectors 86 include threaded ends 90 which can be inserted into apertures 92 of C-shaped receptors 82. The corresponding nuts 94 for threaded ends 90 are then turned down to tighten top strap 70 and the top of ballast box 18 to pole 12.

It is to be understood that top strap 70 can be initially of a longer length and then cut to a length which approximates that needed to surround the portion of pole 12 selected to clamp ballast box 18 to pole 12. It can then be attached to adjustment connectors 86 by bolts 88 through selected holes in strap 70. Adjustment connectors 86 can be used for the final and fine adjustment and clamping action of box 18 to pole 12. Essentially this arrangement would only require the tightening down of nuts 94 once box is positioned on pole 12. All other connections of the brackets of FIG. 6 could be previously made. The V-shaped cut outs 80 of bracket 74 help center the pole and then nuts 94 can be tightened to provide the clamping action. Strap 70 is made preferably of stainless steel and serves to grip pole 12 and clamp the top of box 18 in place.

The arrangement of bottom strap 72 is similar to top strap 70, with the following differences. To eliminate as much as possible the potential for warpage of box 18, pivoting connection bracket 76 is connected to box 18 by bolt 96 and pivot bracket 98. Resilient pads 100 and 102 (in the preferred embodiment made of medium density foam rubber) are attached to ballast box 18 on opposite lateral sides of pivot bracket 98. The opposite sides of bracket 74 therefore extend across pads 100 and 102.

Figure 6A:
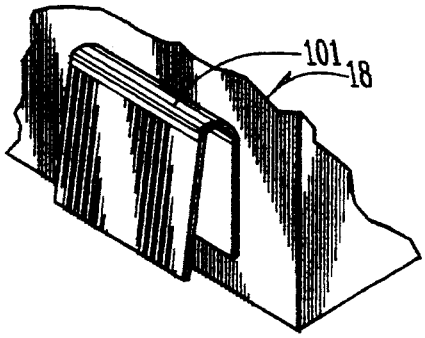
FIG. 6A depicts an alternative to components 100 or 102 of FIG. 6.

This arrangement functions as follows. In normal installation, the length of straps 70 and 72 are cut to as close to size as is possible for the particular pole diameter at the selected location of installation of ballast box 18. Adjustment connectors 86 are bolted by bolts 88 to the free ends of straps 70 and 72. C-shaped receptors 82 are bolted by bolts 84 to the opposite ends of bracket 74. C-shaped receptors 82 are connected by bolts 84 to the opposite ends of pivoting connection bracket 76, and bracket 76 is pivotably connected to pivot bracket 98. Ballast box 18 is brought to pole 12 and roughly positioned at the location of intended installation. V-shaped recesses 80 in brackets 74 and 76 assist in this positioning. Threaded ends 90 of adjustment connectors 86 are then inserted into apertures 92 in C-shaped receptors 82 in bracket 74, and nuts 94 are tightened down to pull the top of ballast box 18 to pole 12. The bottom pivoting bracket 76 and pads 100 and 102 on box 18 cooperate to deter deformation or warpage of box 18 as follows. Pads 100 and 102 extend from the back of box 18 and hold bracket 76 in basically a parallel orientation with respect to the back of box 18 when it is being installed. If any rotation or misalignment, or any force or structure attempts to pivot bracket 76 away from this preferred position, pads 100, 102 will resist the same and urge bracket to remain parallel. One or the other of pads 100 or 102 may come into contact with one side of pivoting connection bracket 76 and will resiliently urge bracket 76 back to a parallel position (meaning a generally parallel orientation to the back of box 18). This will then present bracket 76 in this intended position when threaded ends 90 of adjustment connectors 86 on strap 72 are inserted into C-shaped receptors 82 on pivoting bracket 76. This positioning of bracket 76 assists bracket 76 in transferring stress to the center of box 18 (as opposed to its bottom side edges) when nuts 94 are tightened down on threaded portions 90 of adjustment connectors 86 of bottom strap 72. This, avoids placement of tension on the bottom corners of box 18, which would cause tension on box 18. Thus, it will then deter any deformation or permanent warping of box 18 during and after box 18 is all tightened down to pole 12. It will also tend to keep box 18 centered. Again, the clamping of the bottom of box 18 with bottom strap 72 requires a tightening of only two nuts 94 which is quick, easy, and also deters tension on the corners of box 18. Alternative ways of keeping bracket 72 resiliently positioned parallel are possible. An example would be spring clips 101 (see FIG. 6A) between the ends of bracket 72 and box 18.

Figure 7:
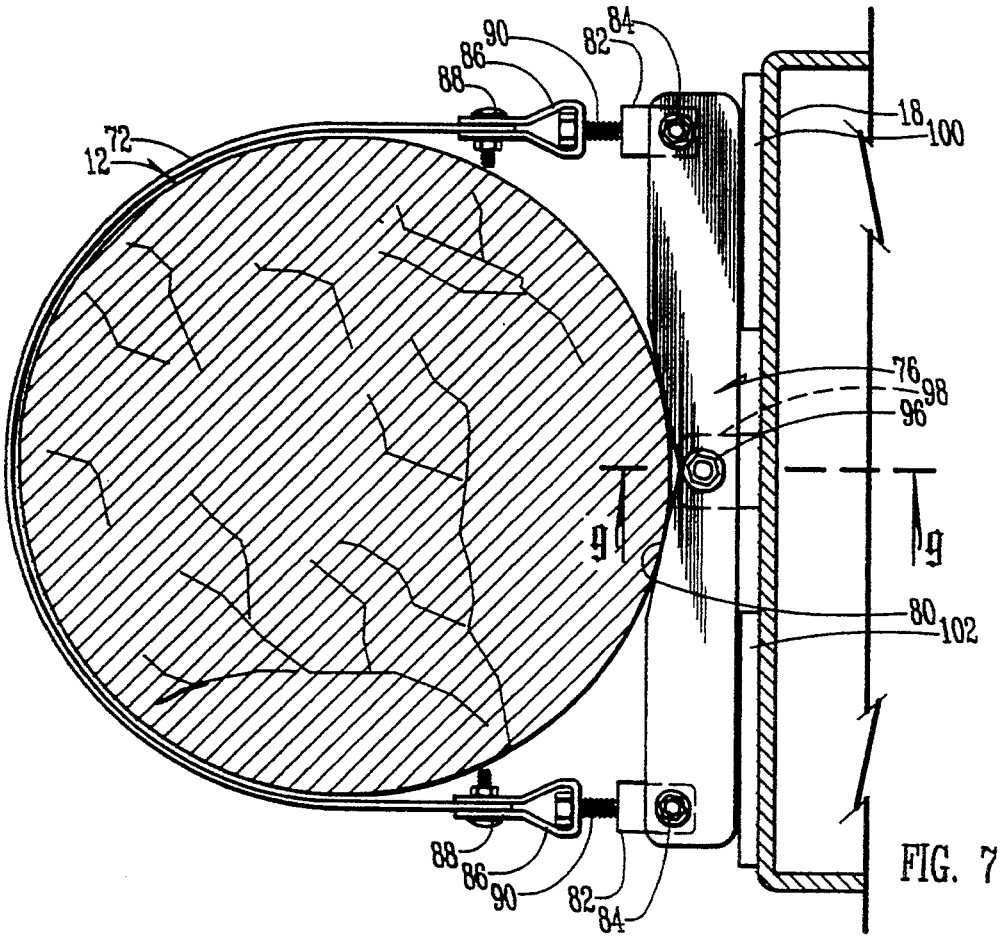
FIG. 7 is an enlarged sectional view taken along line 7—7 of FIG. 6 but showing the pole in solid lines.
Figure 8:
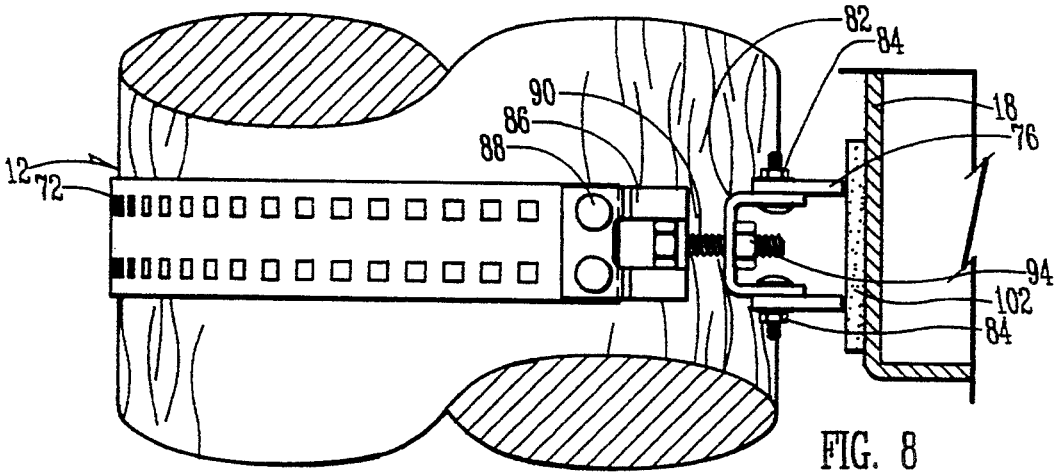
FIG. 8 is an enlarged partial elevational and sectional view taken along line 8—8 of FIG. 6 but showing the pole in solid lines.

FIGS. 7 and 8 show bottom strap 72 and pivoting connection bracket 76 in an installed position. It can be seen that adjustment connectors 86 allow for a range of tightening adjustment by virtue of their threaded length which exceeds that need to initially position nuts 94 on threaded ends 90. FIG. 7 also illustrates the centering nature of pole 12 in V-shaped cut outs 80 and how the centered (parallel) bracket 72 concentrates stress at the center back of box 18.

FIG. 8 shows in more detail the connection of C-shaped receptors 82 to pivoting connection bracket 76, and also the configuration of adjustment connectors 86 and bottom strap 72.

Figure 9:
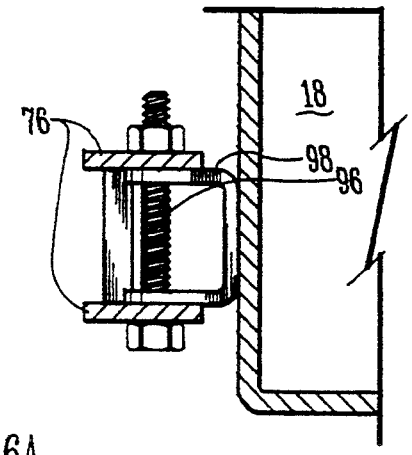
FIG. 9 is an isolated and still further enlarged partial elevational and sectional view taken along line 9—9 of FIG. 7.

FIG. 9 illustrates in more detail the structure of pivot bracket 98 and its connection to pivoting connecting brackets 76.

E. Alternate Mounting System FIGS. 10–12

Figure 10:
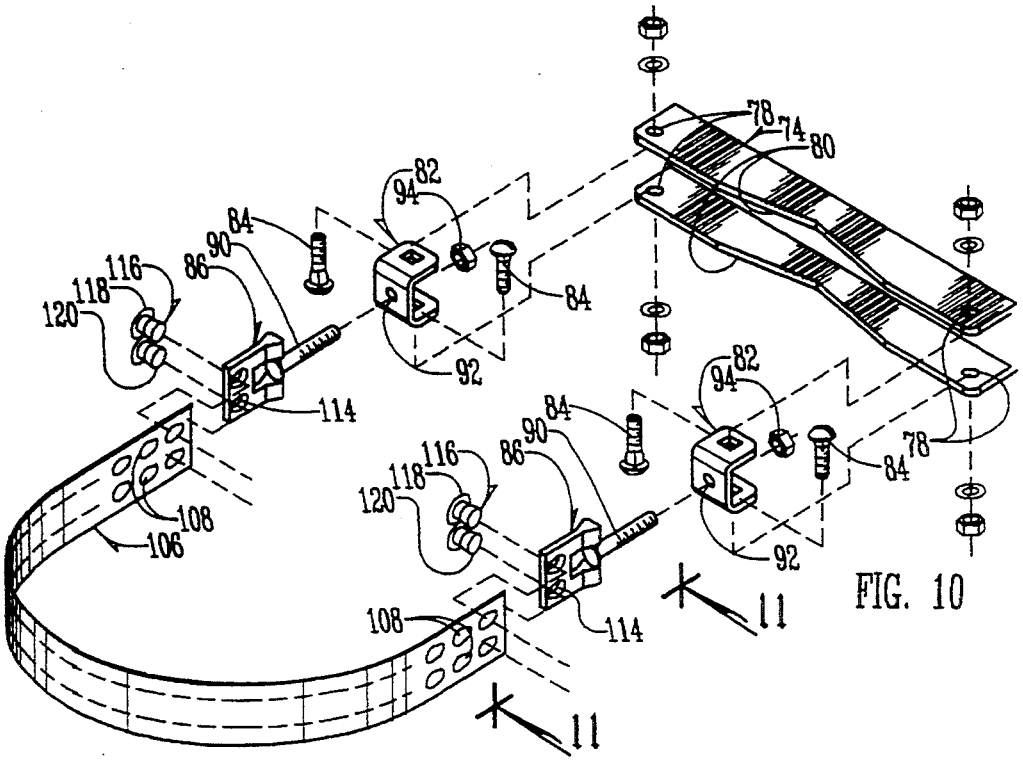
FIG. 10 is an exploded perspective view of an alternative embodiment for the mounting brackets of FIG. 6.
Figure 11:
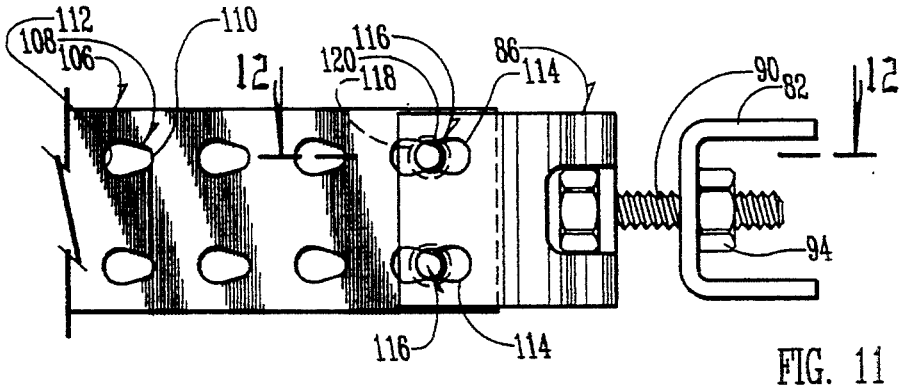
FIG. 11 is an enlarged elevational view taken along line 11—11 of FIG. 10.
Figure 12:
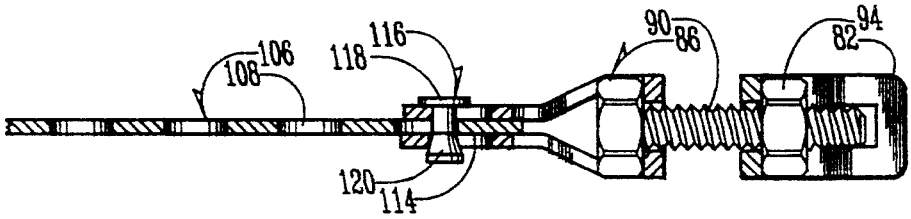
FIG. 12 is a sectional view taken along line 12—12 of FIG. 11.

By referring to FIGS. 10–12, an alternative embodiment of a mounting system for that shown in FIGS. 6–9 is illustrated. It is similar to that shown in FIGS. 6–9 except as follows. Strap 106 has tear-drop shaped or corn kernel shaped apertures 108 in two rows along its length (instead of the two rows of square holes in straps 70 and 72 of FIG. 6). Note that the two rows of apertures can extend the length of strap 106 (as indicated by dashed lines). As shown in FIG. 11, a smaller diameter portion 110 of each aperture 108 expands to a larger diameter portion 112 to make the tear-drop shape. It is to be understood that the smaller diameter portions 110 point towards the ends of strap 106. Thus, the apertures 108 are mirror images of one another at the opposite ends of strap 106.

In direct comparison, similar tear-drop shape apertures 114 exist in adjustment connectors 86 but have the smaller portions (like portions 110) point towards the portions 110 of apertures 108 of strap 106. Two headed pins 116 having a large flat head 118 of a diameter greater than any portion of apertures 108 or 114, and a small or tapered head 120, having a diameter which can pass through large portion 112 of apertures 108 and 114 but will not pass through small portions 110 of apertures 108 and 114, are used to quickly connect the opposite ends of straps 106 to adjustment connectors 86.

It is to be understood that like previously described, strap 106 is first cut to approximate length for the pole diameter at the installation location. C-shaped receptors 92, having been previously connected to bracket 74, for example, and bracket 74 being connected to a structure (for example, ballast box, cross-arm assembly, etc.), await connection of strap 106.

This can be done by either connecting adjustment connections 86 to the ends of strap 106 and then inserting and securing threaded ends 90 of connections 86 into C-shaped receptors 82, or visa versa. In either case, FIGS. 11 and 12 show that the ends of strap 106 would be inserted between sides of adjustment connections 86 (which in original condition are sprung open). The large portions of apertures 114 in connections 86 are aligned with the large portions of apertures 108 in strap 106. The smaller tapered heads 120 of pins 116 are inserted through the aligned large portions of the apertures. When longitudinal tension is applied pulling the ends of strap 106 oppositely from connections 86 the smaller portions of apertures 108 and 114 be pulled to the pin. This essentially shearing action will cooperate with the camming action of tapered heads 120 to close down the sides of connections 86 to sandwich the ends of strap 106 as well as to effectively lock pins 116 in place, and lock strap 106 to connections 86. Strap 106 in the preferred embodiment is only thirty-thousandths of an inch thick. This connection of strap 106 ends to connections 86 capture the thin strap ends so they do not tear.

Therefore, shown in FIGS. 11 and 12, by first appropriately aligning selected apertures 108 and 114 and inserting small heads 120 of two headed pins 116 through corresponding large ends 110 of apertures 108 and 114 of strap 106 and adjustment connector 86 (at either end of strap 106), the strap 106 and adjustment connectors 86 are then pulled in opposite directions so that pin 116 is captured in the small portions of apertures 110 and can not be removed laterally. Nuts 94 can then be turned down to finish the tightening of the mounting system.

The embodiment of FIGS. 10–12 can be used with either fixed connection bracket 74 or pivoting connection bracket 76.

F. Alternative Mounting System FIGS. 13–17

A still further alternative mounting system is shown at FIGS. 13–17. It essentially functions similarly to those shown in FIGS. 6–9 and FIGS. 10–12 except as follows. In this embodiment strap 122 has a first piece 124 and a second piece 126. Apertures 128, in one row, are contained in embossments 130A in piece 124 and embossments 130B in piece 126 of strap 122 (as better shown in FIGS. 15 and 16). These embossments 130A and 130B include cavities 123A and 123B on the back of strap 122 and raised portions 125A and 125B on the front of strap 122; with apertures 128 centered therein.

It is to be understood, as shown in FIGS. 15 and 16 that embossments 130A are sized to be larger then embossments 130B so that raised portions 125B of embossments 130B effectively fit within cavities 123A of embossments 130A. This allows embossments 130B to essentially matingly nest within embossments 130A, so facing surfaces of strap pieces 122 and 124 can abut one another and lock into place.

Strap 122 can be easily coarsely positioned by first connecting adjustment connectors 86 to C-shaped receptors 82 (see FIGS. 14 and 15), which in turn have been installed on bracket 74 (or 76) (see FIGS. 14 and 15), connecting adjustment members 86 to the free ends of strap 122, and then extending first and second pieces 124 and 126 of strap 122 around pole 12. The pieces 124 and 126 are overlapped and bolts 132 and clamps 134 are used to connect the overlapping ends of pieces 124 and 126 in place as shown in FIGS. 13, 16, and 17. Alternatively, strap pieces 124 and 126 could be connected together prior to connecting adjustment connections 86 to bracket 74.

As shown in FIG. 17, threaded inserts 136 can be press-fitted or otherwise secured in selected cavities 123B of the embossments 130B of piece 126 so that bolts 132 can simply be threaded in place through pieces 124 and 126 from the outside of strap 122 to lock them in place.

Once strap pieces 124 and 126 are connected and adjustment connections 86 are connected to C-shaped receptors 82 on bracket 74, nuts 94 can then be turned down with respect to adjustment connectors 86 (see FIG. 14 and 15) to finally secure and cinch this clamp system in place on pole 12.

G. Merged Ballast Box and Cross-arm Assembly—FIG. 18

Figure 18:
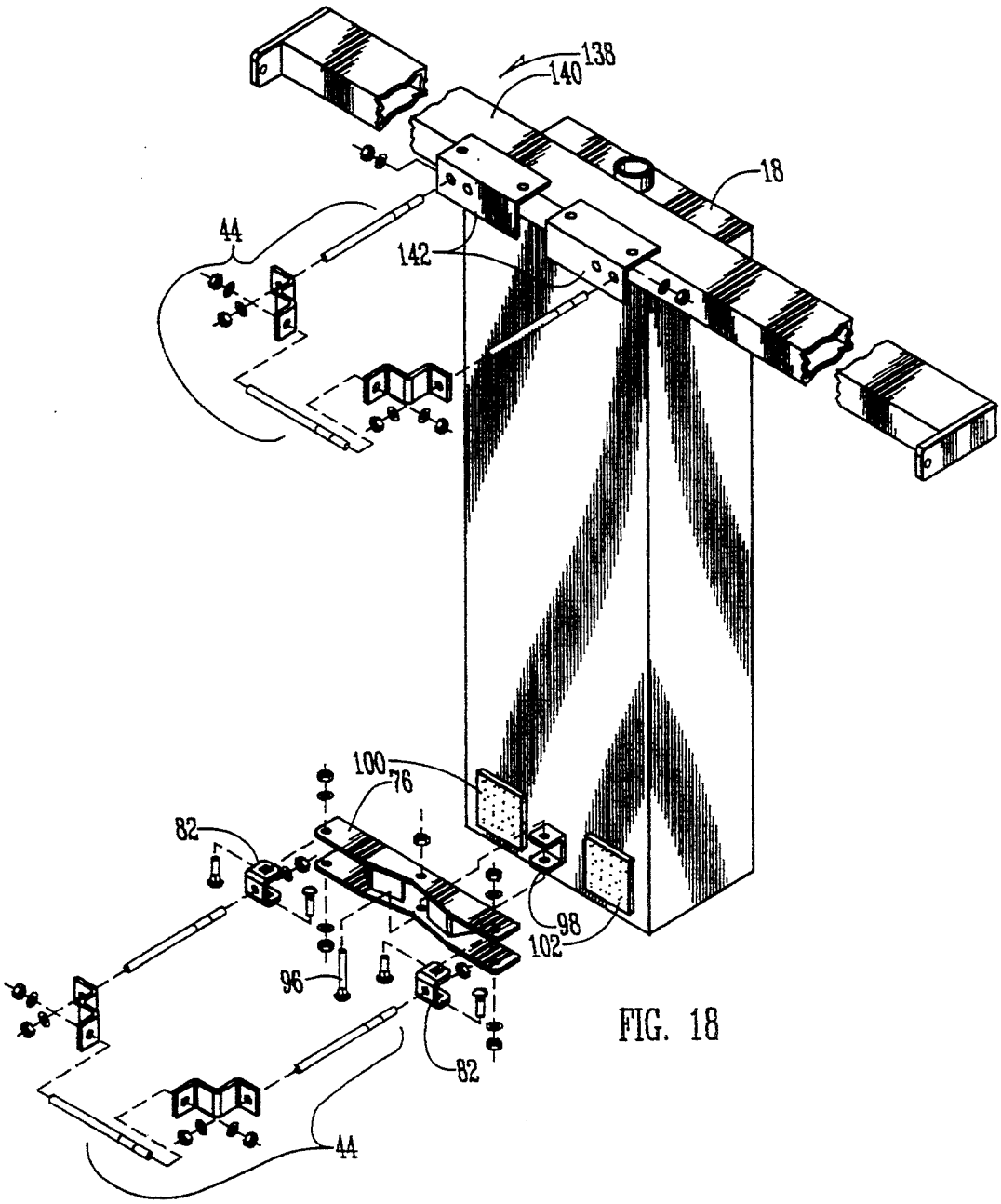
FIG. 18 is a perspective view of a cross-arm and ballast box combination with mounting brackets for a light pole shown in exploded fashion.

FIG. 18 illustrates what will be called a merged ballast box/cross-arm assembly 38. Cross-arm 140 (like cross-arm 26 or 28) is welded to the top of ballast box 18 (or attached by some other means). In this embodiment, "L" brackets 142, secured to cross-arm 140, allow connecting structures such as threaded rods 46 and 50 and "W" brackets 48 to be used to secure the top of the assembly 138 to pole 12. In this example, threaded rods 46 and 50, and "W" brackets 48 could also be used with pivoting connection bracket 76 to connect the bottom of ballast box 18 to pole 12.

Obviously, the different types of alternate strap systems of FIGS. 6–17 could also be used with this embodiment.

H. Alternatives, Features, and Options

As can be appreciated, the invention can take many forms and embodiments. The true essence and spirit of this invention are defined in the appended claims, and it is not intended that the embodiment of the invention presented herein should limit the scope thereof.

What is claimed is:

1. A mounting system for installing a structure along a length of a pole comprising:

an attachment device comprising:

a pivot bracket having a base attached at a side of the structure facing the pole, the pivot bracket having a pivot axis generally parallel with the pole when the structure is installed on the pole;

resilient members positioned on lateral opposite sides of the pivot bracket;

an elongated member pivotably connected to the pivot bracket at a pivot point and having portions extending in opposite directions transverse to the pivot axis and over the resilient members, and including a recessed portion facing the pole generally aligned with the pivot point for receiving and centering the pole in the elongated member;

a securing member attachable at opposite portions of the elongated member and extending around the pole and including adjustable cinching devices to pull the elongated member to the pole.

2. The system of claim 1 wherein the resilient member comprises a pad member.

3. The system of claim 1 wherein the resilient member comprises a spring loaded device.

4. The system of claim 1 wherein the elongated member comprises a pivoting arm with a V-shaped recess generally centered along its length near a pivot axis, the V-shaped recess being adapted to receive a portion of the perimeter of the pole.

5. The system of claim 1 wherein the securing member comprises a flexible strap, and first connections at opposite ends of the strap attachable to adjustment members which are adjustable in length to cinch the strap to the elongated member.

6. The system of claim 5 wherein the strap is stainless steel.

7. The system of claim 5 wherein the strap includes first and second generally parallel rows of apertures to allow selection of a point of attachment of the strap to the first connections.

8. The system of claim 5 wherein the mounting system includes a supplemental attachment device connected to and spaced from the attachment device along the structure.

9. The system of claim 8 wherein the supplemental attachment device includes an elongated member non-pivotably attached to the structure.

10. The system of claim 1 wherein the structure comprises a ballast box having basically a box shape with one side including a door.

11. The system of claim 10 wherein the attachment device is located towards the bottom of the ballast box and the supplemental attachment device is located near the top of the ballast box.

12. The system of claim 5 wherein the securing member comprises a flexible elongated strap having one or more rows of apertures along its length, each aperture asymmetrical in nature having a larger portion decreasing in diameter to a smaller portion in the direction of elongation of the strap.

13. The system of claim 12 wherein the flexible elongated strap connects to the first connection through openings in slightly spread apart walls having a diameter which increases from a smaller to a larger diameter, and including a two headed pin having a first head that does not fit through any portion of the asymmetrical aperture and second head including a tapered portion that fits through the larger diameter portion by camming action causes convergence of the walls when tension is placed on the strap to secure the pin in place.

14. The system of claim 5 wherein the securing member comprises a flexible elongated strap made of two pieces, at least one row of openings along the strap positioned in embossments in the strap, each end of the strap connecting to adjustable connector means, the pieces sized for the diameter of the pole and having different sized embossments so that when overlapped the pieces secured to one another by nesting the embossments of one piece into those in the other piece.

* * * * *

UNITED STATES PATENT AND TRADEMARK OFFICE

CERTIFICATE OF CORRECTION

PATENT NO. : 5,426,577

DATED : June 20, 1995

INVENTOR(S) : Myron K. Gordin & Jim L. Drost

It is certified that error appears in the above-identified patent and that said Letters Patent is hereby corrected as shown below:

Column 11, line 6, of claim 1, please delete "comprising:" and substitute --comprising;--.

Signed and Sealed this

Twenty-ninth Day of August, 1995

*Attest:*

Bruce Lehman

BRUCE LEHMAN

*Attesting Officer*

*Commissioner of Patents and Trademarks*